US007140677B1

(12) United States Patent
Chiu

(10) Patent No.: US 7,140,677 B1
(45) Date of Patent: Nov. 28, 2006

(54) BALL CHAIR

(76) Inventor: Ciber Chiu, No. 54-6, Chipan Lane, Lukang Chen, Changhua Hsien (TW)

( * ) Notice: Subject to any disclaimer, the term of this patent is extended or adjusted under 35 U.S.C. 154(b) by 0 days.

(21) Appl. No.: 11/328,793

(22) Filed: Jan. 10, 2006

(51) Int. Cl.
*A63G 9/10* (2006.01)
*B60N 2/02* (2006.01)

(52) U.S. Cl. ..... 297/181; 297/374; 297/301.4; 297/353

(58) Field of Classification Search ..... 297/374, 297/292, 299, 301.4, 181, 452.21, 353
See application file for complete search history.

(56) References Cited

U.S. PATENT DOCUMENTS 4,062,587 A * 12/1977 Wolters ..... 297/302.3
5,066,069 A * 11/1991 DeGelder ..... 297/374
6,116,682 A * 9/2000 Baur ..... 297/181
6,702,388 B1 * 3/2004 Chiu ..... 297/452.41
6,832,817 B1 * 12/2004 Chiu ..... 297/452.41

* cited by examiner

*Primary Examiner*—Milton Nelson, Jr.
(74) *Attorney, Agent, or Firm*—Frenkel & Associates

(57) ABSTRACT

A ball chair has a seat, a backrest assembly and a ball cushion. The seat has a top face, a passage defined in the top surface of the seat, at least three legs formed on the seat and each leg and a supporting base formed on seat. The backrest assembly mounted on the seat and has a bracket, an angle adjusting device, a locking device and a fixed arm. The bracket has two supporting tabs defined in the bottom of the bracket to abut against the supporting base. The ball cushion is mounted inside the passage in the seat. The ball chair provides functions as adjusting backrest angle and the backrest may be extended for convenient use.

10 Claims, 6 Drawing Sheets

BALL CHAIR

BACKGROUND OF THE INVENTION

1. Field of the Invention

The present invention relates to a ball chair, and more particularly to a ball chair having multiple strengthening blocks at joints of the ball chair to avoid the ball chair from cracking at the joints.

2. Description of the Related Art

A conventional ball chair is composed of a chair and a ball-shaped cushion. With reference to FIGS. 5 and 6, the conventional chair has a seat (50), at least three legs (52), at least three wheels (53), a backrest (54), two arms (56), a ball cushion (60) and a positioning element (70). The seat (50) has with a top face (51), a bottom surface, a side edge, a recess (500) and a passage. The recess (500) is defined in the top surface of the seat (50) near the side edge. The passage is defined in the top face (51) of the seat (50) to receive the ball cushion (60). The legs (52) are attached to the bottom face of the seat (50) to support the ball chair. The wheels (53) are respectively attached to the legs (52). The backrest (54) has an inserted end (542) and presses the ball cushion (60), and the inserted end (542) is mounted inside the recess (500) in the seat (50). The arms (56) are mounted on the side edge of the seat plate (50) and opposite to each other for holding the ball cushion (60) in position. The positioning element (70) is mounted on the arms (56) for holding the ball cushion (60) in position.

When a user sits on the ball chair, the ball cushion (60) is pressed to deform forward. The user is only supported by the backrest (54) inserted into the recess (500), the seat (50) is broken easily at the sidewall of the recess (500) and the backrest (54) is broken easily. Further, the inserted end (542) of the backrest (54) must completely be inserted into the recess (500) in the seat (50), or a poor quality ball chair will be made. Therefore, the backrest (54) cannot provide an enough supporting effect to a user, the conventional ball chair is not safe and stable in use.

The present invention has arisen to mitigate or obviate the disadvantages of the conventional ball chair.

SUMMARY OF THE INVENTION

The main objective of the present invention is to provide a ball chair with a reinforced structure that avoids a seat from cracking at joints and safe and steady in use.

A ball chair has a seat, a backrest assembly and a ball cushion. The seat has a top face, a passage defined in the top surface of the seat, at least three legs formed on the seat and each leg and a supporting base formed on seat. The backrest assembly mounted on the seat and has a bracket, an angle adjusting device, a locking device and a fixed arm. The bracket has two supporting tabs defined in the bottom of the bracket to abut against the supporting base. The ball cushion is mounted inside the passage in the seat.

The ball chair in accordance with the present invention provides functions as adjusting backrest angle and the backrest may be extended for convenient use.

Other objectives, advantages and novel features of the invention will become more apparent from the following detailed description when taken in conjunction with the accompanying drawings.

DETAILED DESCRIPTION OF THE INVENTION

Figure 1:
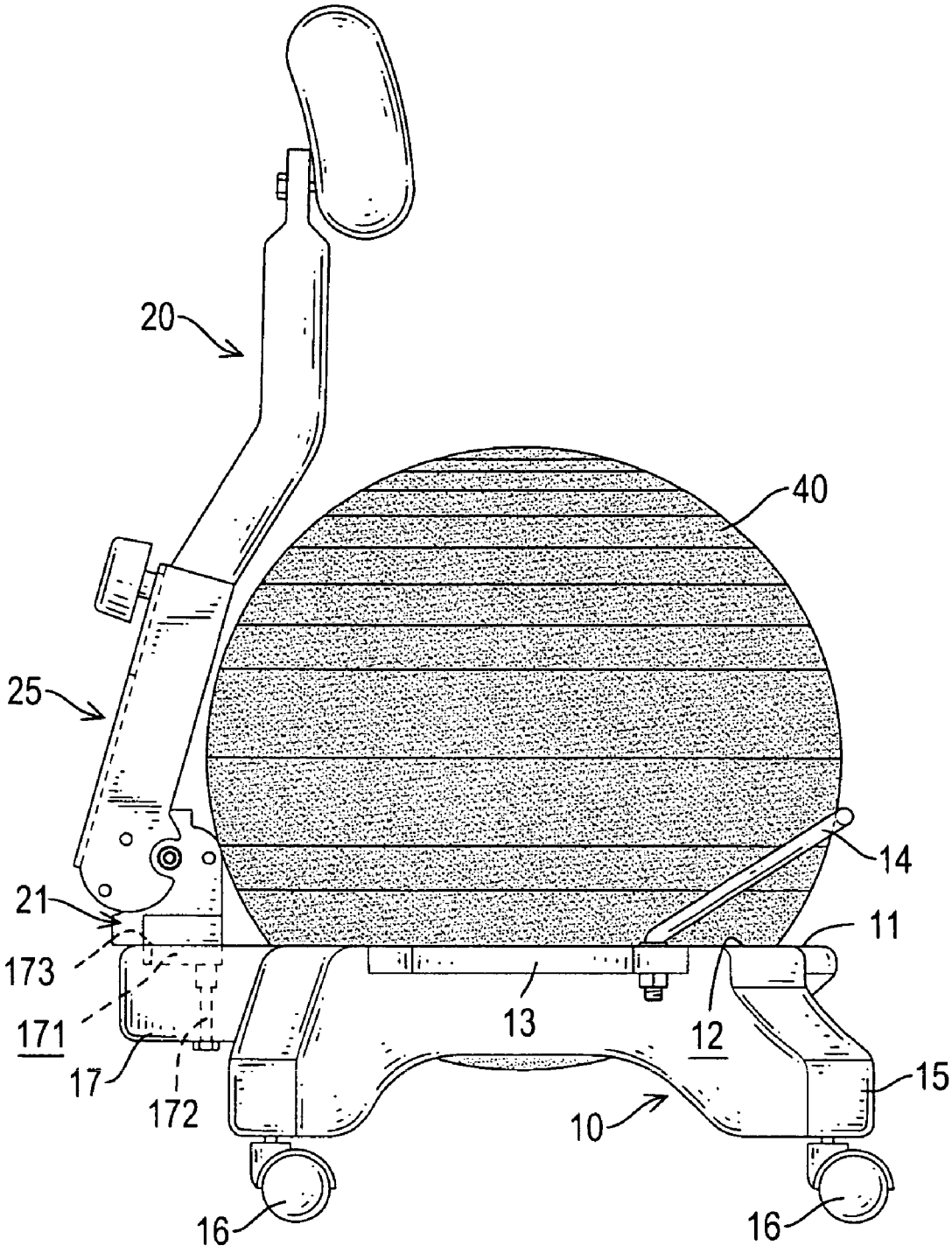
FIG. 1 is a side view of a ball chair in accordance with the present invention.
Figure 2:
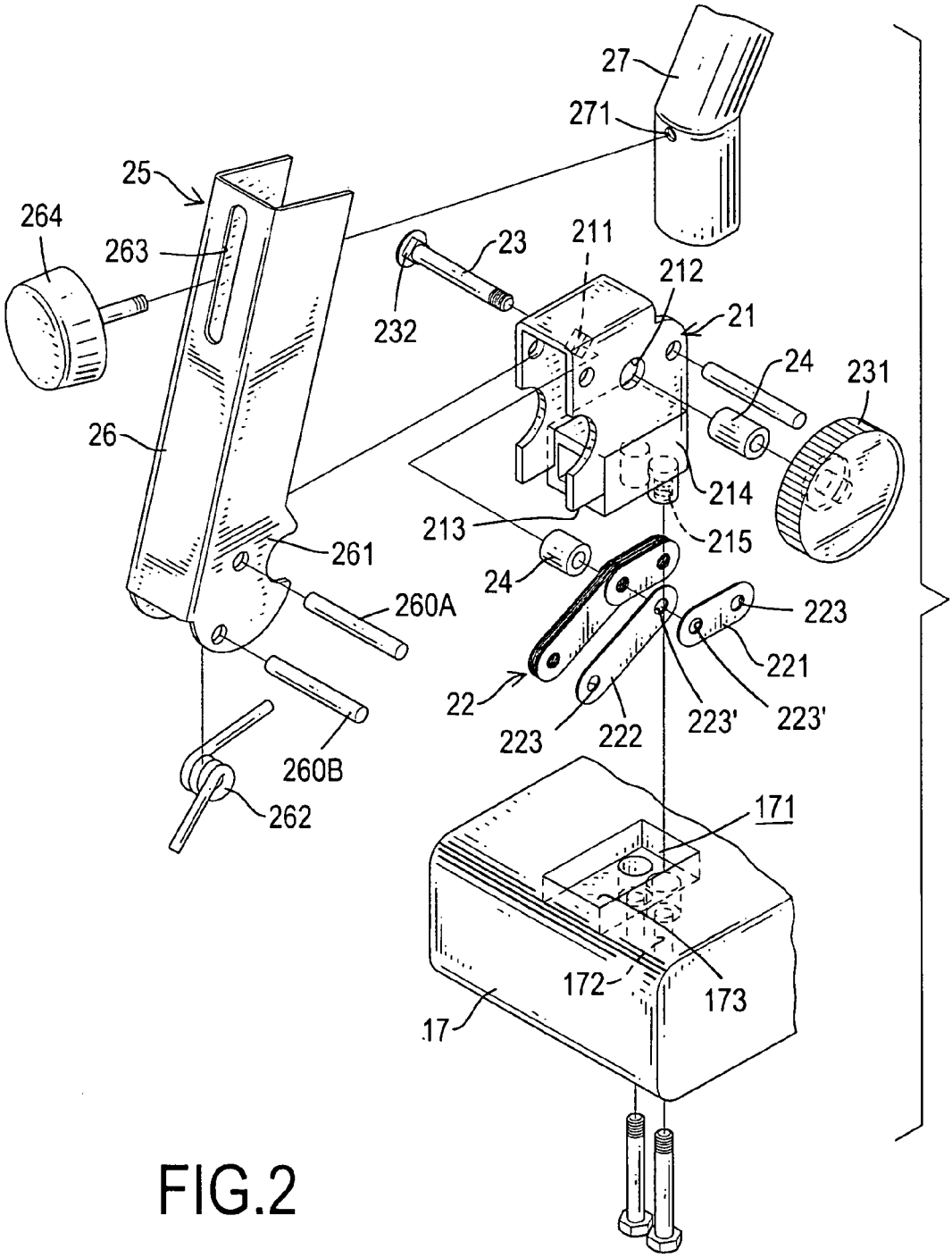
FIG. 2 is an exploded perspective view of the backrest assembly of the ball chair in FIG. 1.

With reference to FIGS. 1 and 2, a ball chair in accordance with the present invention comprises a seat (10), a backrest assembly (20) and a ball-shaped cushion (40).

The seat (10) has a top face (11), a bottom face, a front edge, a rear edge, two side edges, a passage (12), two arms (13), a positioning element (14), at least three legs (15), at least three optional wheels (16) and a supporting base (17). The passage (12) is defined in the top surface (11) of the seat (10). The arms (13) are formed respectively on the side edges of the seat (10). The positioning element (14) is mounted on the arms (13) for holding the ball cushion (40) in position. The legs (15) are formed in the bottom surface of the seat and each leg (15) has a free end. The wheels (16) are respectively mounted on the free ends of the legs (15). The supporting base (17) is formed on the rear edge of seat (10). The supporting base (17) has a top surface, a recess (171) and two optional through holes (172). The recess (171) is defined in the top surface and has an attachment bottom (173). The through holes (172) separately are defined in the attachment bottom (173) of the recess (171).

The backrest assembly (20) is mounted on supporting base (17) on the seat (10) and has a backrest (25) and an optional pad. The backrest (25) has a bracket (21), an optional angle adjusting device (22), an optional locking device (23), two optional sleeves (24), a fixed arm (26) and an optional extended arm (27).

The bracket (21) is mounted on the supporting base (17) of the seat (10) and has two side walls, a bottom, a rear, an optional non-circular hole (211), an optional through hole (212), two supporting tabs (213), a holder (214), two optional stubs (215) and two bolts. The non-circular hole (211) is defined in one of the side walls. The through hole (212) is defined in the other side wall and corresponds to the non-circular hole (211). The supporting tabs (213) are formed on the bottom of the bracket (21) at the rear and abut against the top surface of the supporting base (17). The holder (214) is mounted on the bottom of the bracket (21) beside the supporting tabs (213). The stubs (215) are respectively formed on the holder (214) at the bottom of the bracket (21) and each have a threaded hole. The bolts extend respectively through the through holes (172) in the supporting base (17) and are screwed respectively into the threaded holes in the stubs (215) to securely attach the backrest (21) to the supporting base (17).

The angle adjusting device (22) is mounted inside the bracket (21) and has multiple short flakes (221) and multiple long flakes (222). Each short and long flakes (221, 222) has two ends, a pivoting hole (223') and a mounting hole (223). The short flakes (221) and the long flakes (222) are mounted together alternatively and overlap with each other at one end. The pivoting holes (223') are respectively defined in the overlapped ends of the short and long flakes (221, 222) and are aligned with each other. The mounting holes (223) are respectively defined in the other ends of the short and long flakes (221, 222). A fixed pin extends through the mounting holes (223) in the short flakes (221) to attach the short flakes (221) to the bracket (21).

The locking device (23) is mounted through the bracket (21) and the holes in the overlapped ends of the short flakes (221) and the long flakes (222). The locking device (23) has a bolt and a nut (231). The bolt has a threaded end, a fixed end and a non-circular head (232). The non-circular head (232) is formed on the fixed end and corresponds to the non-circular hole (211) in the bracket (21). The threaded end extends through the non-circular hole (211), the pivoting holes (223') in the overlapped ends of the flakes (221,222) and the through hole (212), and the non-circular head (232) is mounted inside the noncircular hole (211). The nut (231) is screwed onto the threaded end of the bolt and abuts one of the side walls of the bracket (21).

Figure 4:
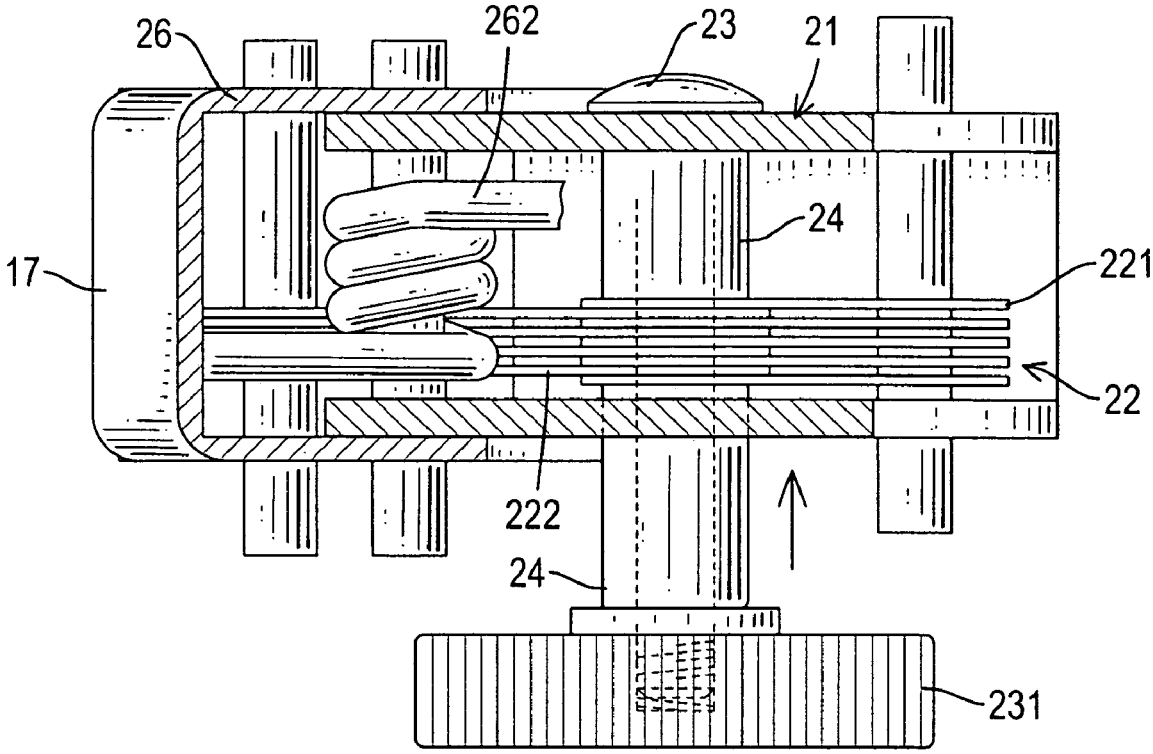
FIG. 4 is a top side view in partial section of the backrest assembly of the ball chair in FIG. 2.
Figure 5:
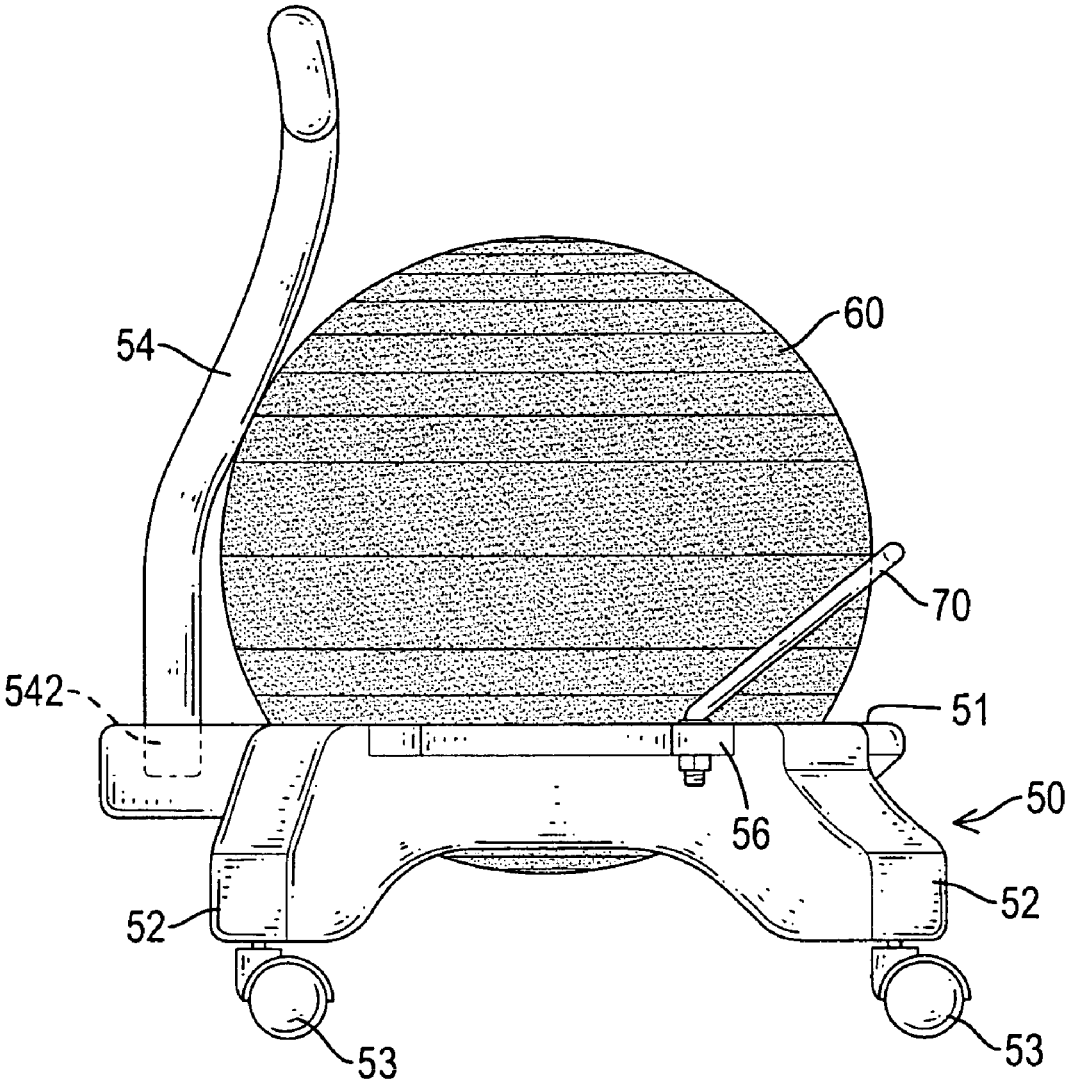
FIG.5 PRIOR ART
FIG. 5 is a side view of a conventional ball chair in accordance with the prior art.
Figure 6:
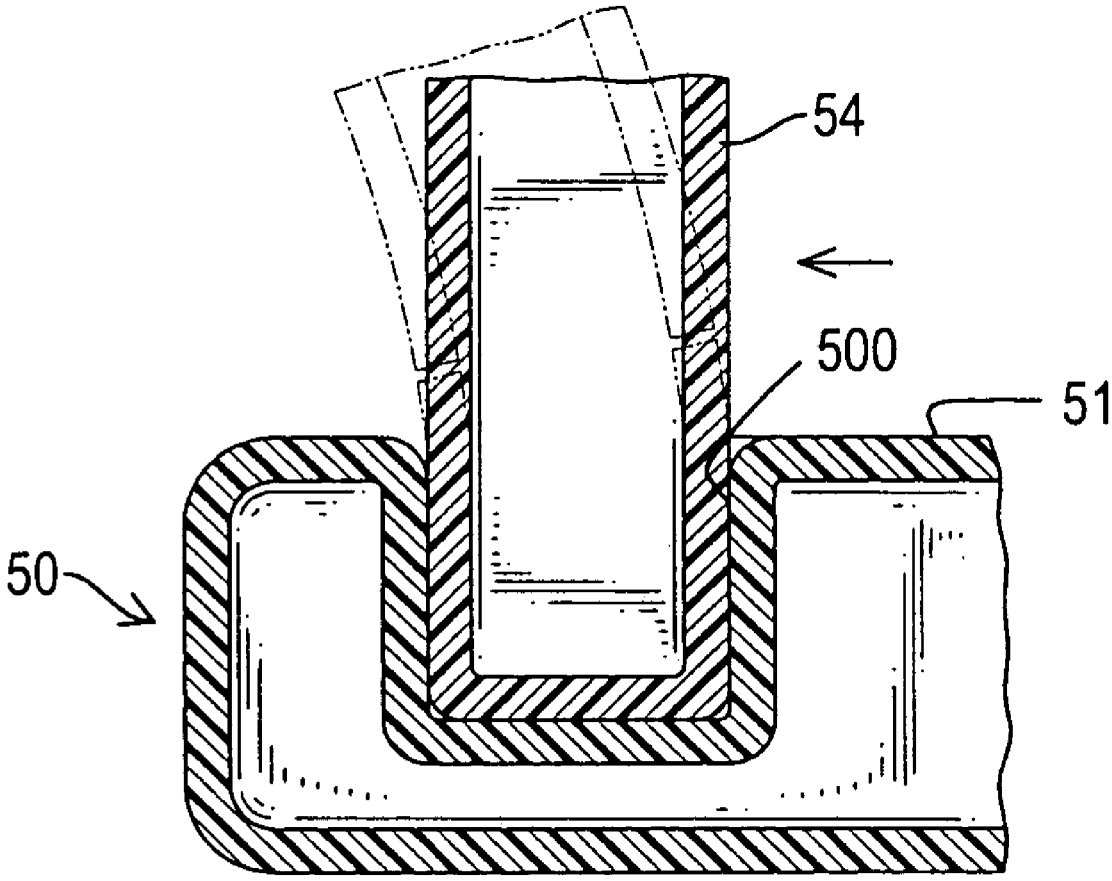
FIG.6 PRIOR ART
FIG. 6 is an operational cross sectional side view of the conventional ball chair in FIG. 5.

With further reference to FIG. 4, the sleeves (24) are mounted around the bolt. One of the sleeve (24) is mounted inside the bracket (21) and abuts the overlapped ends of the flakes (221, 222). The other sleeve (24) is mounted outside the bracket (21) and abuts with the nut (231).

The fixed arm (26) is mounted outside the bracket (21) and has an inner surface, a bottom, a first pin (260A), a second pin (260B), a rear surface, two wings (261), an optional spring (262), an optional elongated hole (263) and an optional nut (264). The bottom is mounted on the bracket (21) and the wings (261) mounted outside the side walls of the bracket (21). The pins (260A, 260B) are mounted on the fixed arm (26) in parallel. The second pin (260B) is mounted through the pivoting holes (223') in the long flakes (221, 222). The spring (262) is mounted inside the fixed arm (26) and is mounted around the first pin (260A) and has two ends. One of the ends of the spring (262) abuts the top inner surface of the bracket (21) and the other end of the spring (262) abuts the inner surface of the fixed arm (26). The elongated hole (263) is longitudinally defined in the rear surface of the fixed arm (26). The nut (264) is attached to the rear surface of the fixed arm (26) and has a threaded rod extending through the elongated hole (263).

The extended arm (27) is mounted on the fixed arm (26) and has a rear surface and a threaded hole (271). The threaded hole (271) is defined in the rear surface and corresponds to the elongated hole (263). The threaded rod of the nut (264) extends through the elongated hole (263) and is screwed into the threaded hole (271) for holding the arms (26, 27) together.

The pad is attached on the top end of the backrest (25).

The ball cushion (40) is mounted inside the passage (12) in the seat (10).

Figure 3:
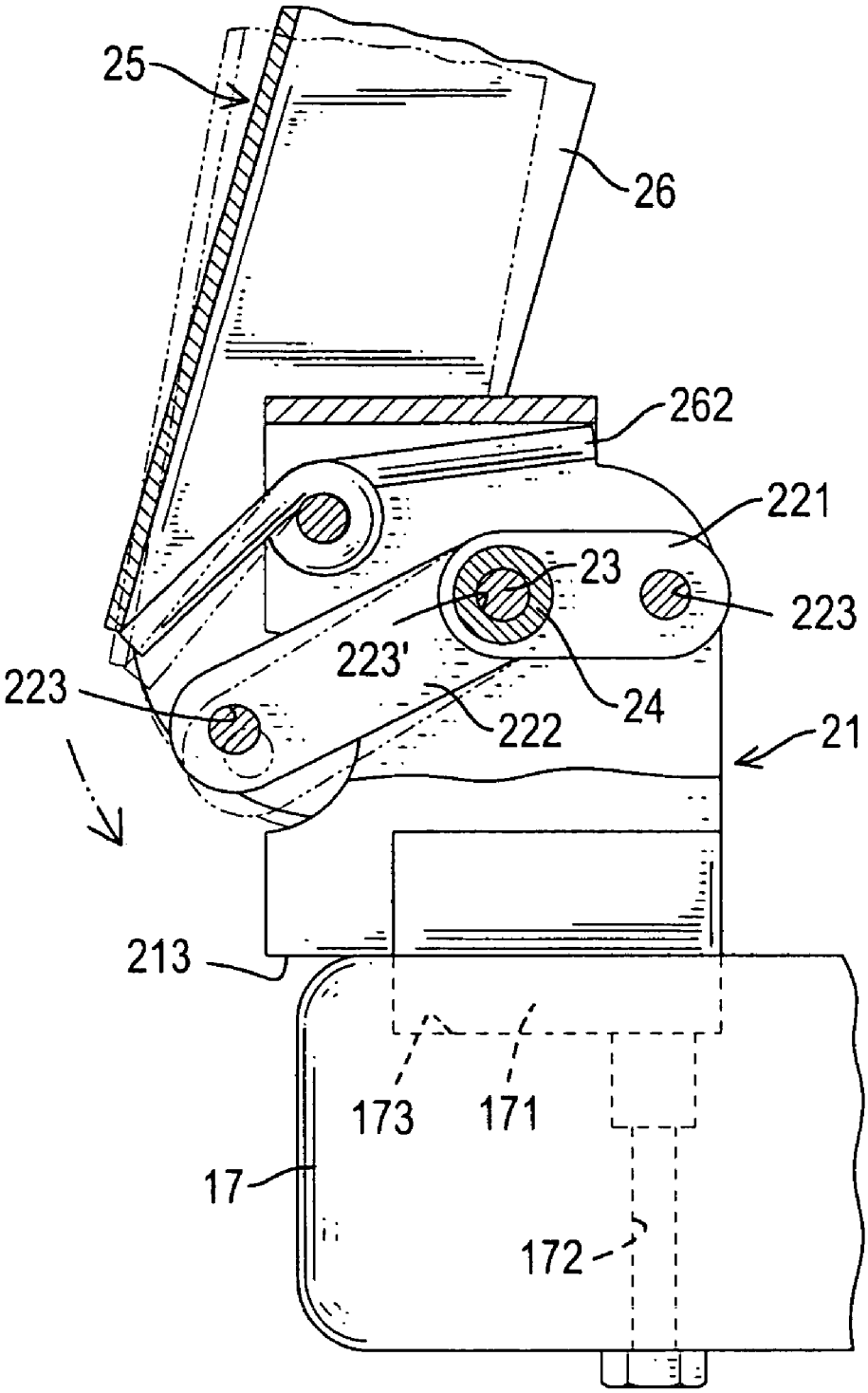
FIG. 3 is an elongated side view in partial section of the backrest assembly of the ball chair in FIG. 2.

With reference to FIGS. 3 to 4, when the nut (231) is loosened, the backrest device (20) can be pivotally rotated relative to the bolt of the locking device (23). The angle adjusted device (22) mounted inside the bracket (21) is rotated around the second pin (260B) for angle adjusting. When the backrest (25) is pivoted to a desired position, the nut (231) is retighten to push against the outer sleeve (24). Accordingly, the overlapping ends of the flakes (221,222) are squeezed between the inner sleeve (24) and the side wall of the bracket (21) to increase the friction between the overlapping flakes (221, 222). Consequently, the rotation of the long flakes (222) is prevented, and the backrest (25) is held in the desired position. Furthermore, the extended arm (27) of the backrest device (20) may be extended if needs.

The advantages of the ball chair in accordance with the present invention are as follows.

1. Because partial holder (214) is mounted inside the recess (171) in the supporting base (17) and abuts against the attachment bottom (173) in the recess (171) and the stubs (215) are mounted into the through holes (172), the backrest (25) and the supporting base (17) provides a strong support effect to a user and not be broken easily.

2. A user may thrust out his chest along the curved surface of the ball cushion (40) or expand his/her body on the ball cushion (40), the ball chair in according to the present invention is not only served as a chair, but also served s an exercise equipment.

3. The ball chair has the simple angle adjusted device for angle adjusting and the extended arm (27) for backrest extending, the ball chair is ergonomic and convenient to use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A ball chair comprising:

a seat having
- a top face,
- a bottom face,
- a front edge,
- a rear edge,
- two side edges,
- a passage defined in the top surface of the seat,
- at least three legs formed in the bottom surface of the seat and each leg having a free end, and
- a supporting base formed on the rear edge of seat having
  - a top surface,
  - a recess defined in the top surface and having an attached bottom defined in the recess, a backrest assembly mounted on the supporting base on the seat and having
- a backrest having
  - a bracket mounted on the supporting base of the seat having
    - two side walls,
    - a bottom,
    - a rear,
    - two supporting tabs formed on the bottom of the bracket at the rear and abutting against the supporting base, and
    - a holder mounted on the bottom of the bracket beside the supporting tabs and abutting with the attached bottom of the recess defined in the supporting base, and
  - a fixed arm mounted on the bracket, and a ball cushion mounted inside the passage in the seat.

2. The ball chair as claimed in claim 1, wherein the supporting base further comprises two through holes separately defined in the attached bottom of the recess, and the bracket further comprises two stubs formed on the holder at the bottom of the bracket and mounted respectively within the through holes in the recess, each stub having a threaded hole, and two bolts extending respectively through the through holes and screwed respectively into the threaded holes in the stubs to attach the backrest to the supporting base.

3. The ball chair as claimed in claim 2, wherein the fixed arm of the backrest assembly has an inner surface, a bottom mounted on the bracket, a rear surface, two wings mounted outside the side walls of the bracket, an elongated hole longitudinally defined in the rear surface of the fixed arm, and a nut attached to the rear surface and having a threaded rod extending through the elongated hole, and the backrest assembly comprises an extended arm mounted on the fixed arm and having a rear surface, and a threaded hole defined in the rear surface and corresponding to the elongated hole in the fixed arm, wherein the threaded rod on the nut is screwed into the threaded hole in the extended arm.

4. A ball chair comprising a seat having a top face, a bottom face, a front edge, a rear edge, two side edges, a passage defined in the top surface of the seat, at least three legs formed in the bottom surface of the seat and each leg having a free end, and a supporting base formed on the rear edge of the seat having a top surface, a recess defined in the top surface, and an attached surface formed inside the recess, a backrest assembly mounted on the seat and having a backrest having a bracket mounted on the supporting base of the seat having two side walls, a bottom, a rear, two supporting tabs formed on the bottom of the bracket at the rear pressing the supporting base, and a holder mounted on the bottom of the bracket beside the supporting tabs and pressed on the attached surface of the supporting base, an angle adjusting device mounted inside the bracket, a locking device mounted through the bracket, a fixed arm mounted on the bracket, and a ball cushion mounted inside the passage in the seat.

5. The ball chair as claimed in claim 4, wherein the backrest assembly further comprises two sleeves mounted inside the bracket of the backrest, the bracket further comprises a non-circular hole defined in one of the side walls, the angle adjusting device comprises multiple short flakes, each short flake having two ends, a pivoting hole and a mounting hole respectively defined in the two ends of the short flake, and multiple long flakes, each long flake having two ends, a pivoting hole and a mounting hole respectively defined in the two ends of the long flake, wherein the short flakes and the long flakes are mounted with each other alternatively and are overlapped with each other at one end to make the pivoting holes at the overlapped ends align with each other, the locking device mounted inside the bracket comprises a bolt mounted through the bracket, the pivoting holes in the overlapped ends of the short flakes and the long flakes, and having a threaded end, a fixed end, and a non-circular head formed on the fixed end corresponding to the non-circular hole in the bracket, a nut threaded on the threaded end of the bolt and abutting with the side wall of the bracket opposite to the non-circular head, and the fixed arm further comprises a spring mounted inside the fixed arm and having two ends, one of the ends of the spring abutting with the top inner surface of the bracket and the other end of the spring abutting the inner surface of the fixed arm.

6. The ball chair as claimed in claim 5, wherein the fixed arm of the backrest assembly has an inner surface, a bottom mounted on the bracket, a rear surface, two wings mounted outside the side walls of the bracket, an elongated hole longitudinally defined in the rear surface of the fixed arm, and a nut attached to the rear surface and having a threaded rod extending through the elongated hole, and the backrest assembly comprises an extended arm mounted on the fixed arm and having a rear surface, and a threaded hole defined in the rear surface and corresponding to the elongated hole in the fixed arm, wherein the threaded rod on the nut is screwed into the threaded hole in the extended arm.

7. The ball chair as claimed in claim 6, wherein the supporting base further comprises two through holes separately defined in a bottom of the recess, and the bracket further comprises two stubs respectively formed on the holder at the bottom of the bracket and each having a threaded hole, and two bolts extend respectively through the through holes and are screwed respectively into the threaded holes in the stubs to attach the backrest to the supporting base.

8. The ball chair as claimed in claim 7, wherein at least three wheels are respectively mounted on the free ends of the at least three legs.

9. The ball chair as claimed in claim 4, wherein the fixed arm of the backrest assembly has an inner surface, a bottom mounted on the bracket, a rear surface, two wings mounted outside the side walls of the bracket, an elongated hole longitudinally defined in the rear surface of the fixed arm, and a nut attached to the rear surface and having a threaded rod extending through the elongated hole, and the backrest assembly comprises an extended arm mounted on the fixed arm and having a rear surface, and a threaded hole defined in the rear surface and corresponding to the elongated hole in the fixed arm, wherein the threaded rod on the nut is screwed into the threaded hole in the extended arm.

10. The ball chair as claimed in claim 4, wherein the supporting base further comprises two through holes separately defined in a bottom of the recess, and the bracket further comprises two stubs respectively formed on the holder at the bottom of the bracket and each having a threaded hole, and two bolts extend respectively through the through holes and are screwed respectively into the threaded holes in the stubs to attach the backrest to the supporting base.

* * * * *